US006601590B2

(12) United States Patent
Neary

(10) Patent No.: US 6,601,590 B2
(45) **Date of Patent: *Aug. 5, 2003**

(54) HAIR ACCESSORY WITH LOOPS AND METHOD OF USE

(76) Inventor: Lynn L. Neary, 8262 Honor Pl., Cotati, CA (US) 94931

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 112 days.

(21) Appl. No.: 09/752,754

(22) Filed: Dec. 29, 2000

(65) Prior Publication Data

US 2001/0029963 A1 Oct. 18, 2001

Related U.S. Application Data

(60) Provisional application No. 60/173,683, filed on Dec. 29, 1999.

(51) Int. Cl.[7] ..... A45D 8/00

(52) U.S. Cl. ..... 132/275; 132/200; 132/273

(58) Field of Search ..... 132/200, 210, 132/212, 273, 275; 63/11; D28/11; 24/300, 712, 715.3, 715.4; 2/171, 209.3, DIG. 11

(56) References Cited

U.S. PATENT DOCUMENTS

| | | | | | |
|---|---|---|---|---|---|
| 5,301,696 | A | * | 4/1994 | Revson | 132/273 |
| D348,331 | S | * | 6/1994 | Marrese | D28/41 |
| 5,379,782 | A | * | 1/1995 | Tabb | 132/275 |
| 5,456,270 | A | * | 10/1995 | Wong | 132/210 |
| 5,497,795 | A | * | 3/1996 | Hibbard | 132/200 |
| D388,588 | S | * | 1/1998 | Gruters et al. | D2/866 |
| 5,947,129 | A | * | 9/1999 | Bradshaw | 132/54 |
| 6,314,969 | B1 | * | 11/2001 | Lacause | 132/275 |

* cited by examiner

*Primary Examiner*—Eduardo C. Robert
*Assistant Examiner*—David Comstock
(74) *Attorney, Agent, or Firm*—Thomas R. Lampe

(57) ABSTRACT

A hair accessory and method of use for a woman's hair located at the apex of the head. The hair accessory includes a central angulated elastic hair band having an outer circumferential surface and a series of angulated elastic hair loops each integrally attached to the central hair band at the outer circumferential surface thereof. The respective axes of symmetry of the central hair band and the series of hair loops are coextensive and parallel. The shape of the central band and loops can vary from circular to ellipsoidal.

8 Claims, 3 Drawing Sheets

HAIR ACCESSORY WITH LOOPS AND METHOD OF USE

RELATED APPLICATIONS

This is a continuation of Ser. No. 60/173,683 for "HAIR BAND WITH LOOPS" filed Dec. 29, 1999.

SCOPE OF THE INVENTION

The invention relates to a hair accessory for a women's hair located at the apex of the head including a central annular elastic hair band of diameter D having an outer circumferential surface and a series of annular elastic hair loops each of diameter D1 integrally attached to the central hair band at the outer circumferential surface thereof where D is greater than D1, say 3D1 is equal to D. The respective axes of symmetry of the cenral hair band and the series of hair loops are coextensive and parallel. Result: different diametered hair stands can be captured by the combination of the central hair band and the series of loops to create novel hairstyles. The shape of the central band and loops can vary from circular say to ellipsoidal,

BACKGROUND OF THE INVENTION

The prior art is replete with various hairband designs but none have the characteristics of the instant invention.

SUMMARY OF THE INVENTION

In accordance with the invention, a hair accessory is described for a women's hair located at the apex of the head. The hair accessory includes a central angulated elastic hair band having an outer circumferential surface and a series of angulated elastic hair loops each integrally attached to the central hair band at the outer circumferential surface thereof. The respective axes of symmetry of the central hair band and the series of hair loops are coextensive and parallel. Result: different diametered hair stands can be captured by the combination of the central hair band and the series of loops to create novel hairstyles. The shape of the central band and loops can vary from circular say to ellipsoidal. A method of use is also described.

DETAILED DESCRIPTION OF EMBODIMENTS

Figure 1:
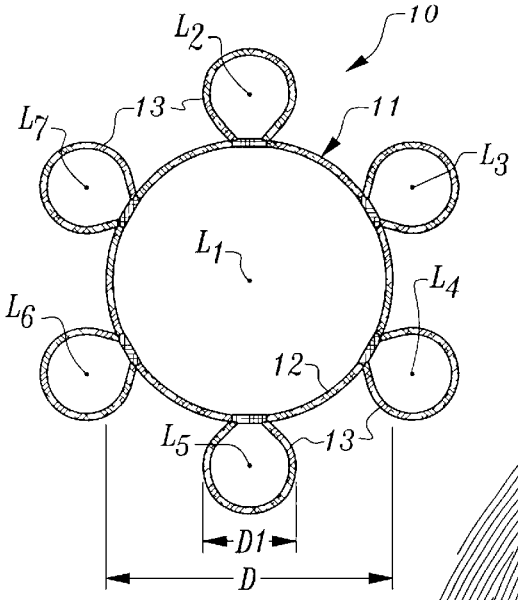
FIG. 1 is a front elevation view of the hair accessory of the invention with 6 loops in accordance with the invention.

As shown in FIG. 1, a hair accessory 10 is shown. It includes a central annular elastic hair band 11 of diameter D having an outer circumferential surface 12. A series of annular elastic hair loops 13 each of diameter D1 integrally attached to the central hair band 11 at the outer circumferential surface 12 thereof where D is greater than D1, say 3D1 is equal to D. The respective axes of symmetry L1 . . . L7 of the cenral hair band and the series of hair loops are coextensive and parallel to each other.

Figure 2:
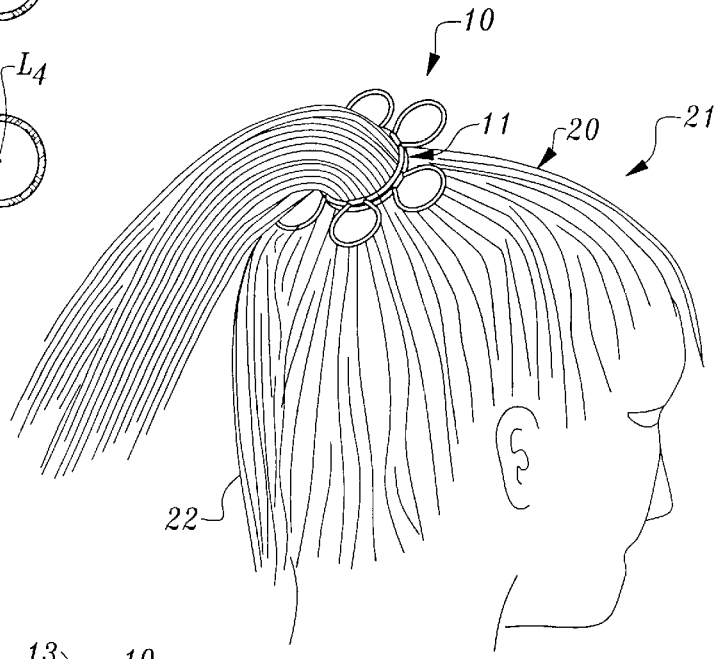
FIG. 2 is a perspective view of the hair accessory of FIG. 1 attached to the hair of a woman in which there is an absence of hair through the loops.

FIG. 2 shows usage of the hair accessory 10 of the invention.

As shown, the hair accessory 10 is attached to the apex of the head 20 of a woman 21. Note that hair 22 is captured only within the central band 11 by conventional infusion of the hair 22 of greater diameter than the latter so that its expansion captures the hair 22 therein. To provide capture, the "workings" diameter of central band 11 can be reduced by a factor of two by twisting the central band 11 from diametrically opposed segments and then overlaying the reduced half-segments over each other. Next, a strand of the hair 22 is inserted through the overlapped half-segments.

Figure 3:
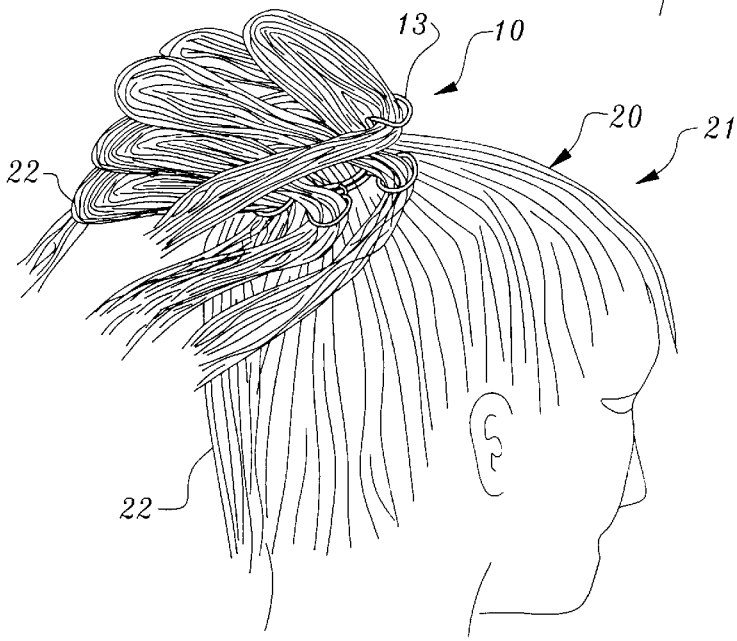
FIG. 3 is another perspective view of the hair accessory of FIG. 1 attached to the hair of a woman in which a few strands of hair have been captured within the loops.

FIG. 3 shows other usage of the hair accessory 10 of the invention.

As shown, the hair accessory 10 is again attached to the apex of the head 20 of a women 21. Note that hair 22 is captured only within the loops 13. To provide capture, the "working" diameter of each loop 13 can be reduced by a factor of two by twisting each such loop 13 from diametrically opposed segments and then overlaying the reduced half-segments over each other. Next, a strand of the hair 22 is inserted through the overlapped half-segments.

Figure 4:
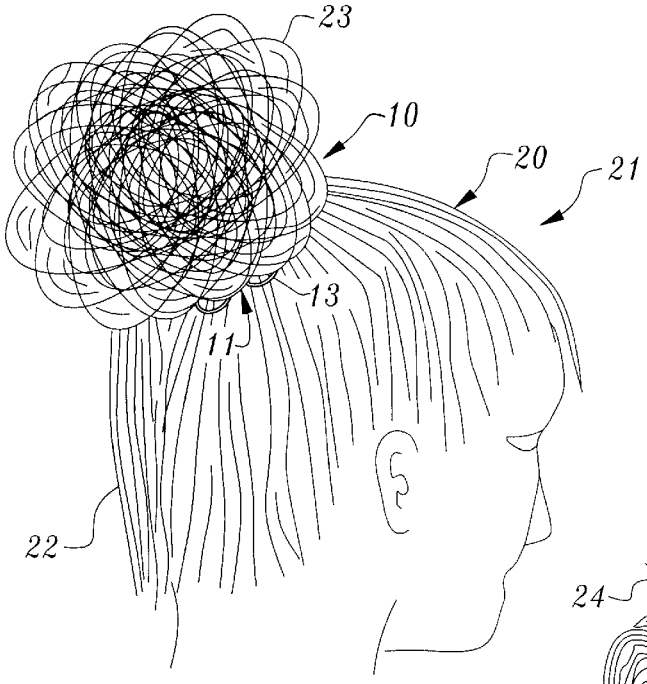
FIG. 4 is yet another perspective view of the hair accessory of FIG. 1 attached to the hair of a woman in which many strands of hair have been captured within the loops to form a bun.
Figure 5:
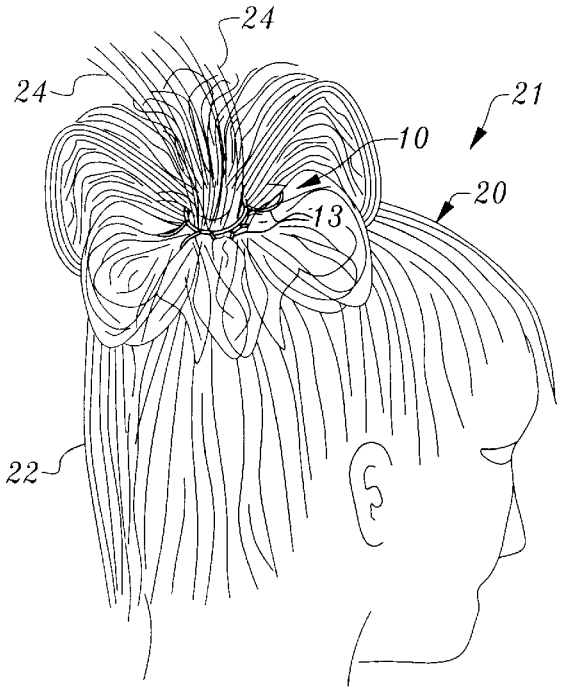
FIG. 5 is a front elevation view of another hair accessory of the invention showing 4 loops in accordance with the invention.

FIGS. 4 and 5 show other usage of the hair accessory 10 of the invention.

As shown, the hair accessory 10 is again attached to the apex of the head 20 of a women 21. Note that hair 22 is captured both with central band 11 and within the loops 13. In FIG. 4, the hair 22 forms a bun 23. In FIG. 5, the hair 22 forms spikes 24. Note that the effective diameters of the central band 11 and the loops 13 can be reduced in the manner set forth above.

In accordance with FIGS. 2–5, note that many different hair styles can be easily achieved. That is to say, different diametered hair stands can be captured by the combination of the central hair band 11 and the series of loops 13 to create many novel hairstyles.

Figure 6:
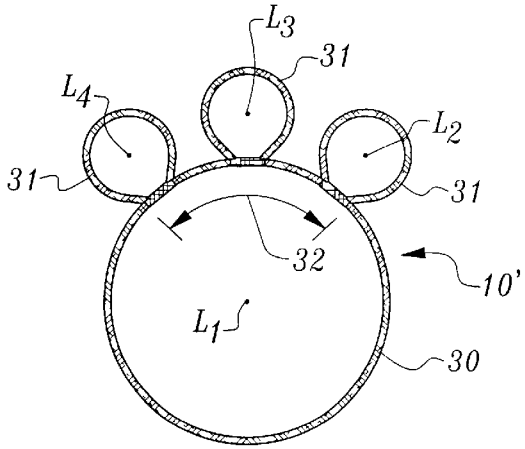
FIG. 6 is a front elevation view of yet another hair accessory of the invention showing 3 loops with beads strings attached to the central band in accordance with the invention.

FIG. 6 shows another embodiment of the hair accessory of the invention.

As shown, hair accessory 10' is composed a central elastic band 30 having three loops 31 formed over a segment 32 of the band 30 where the length G of the segment 32 is about ⅓ of the total circumference of the band 30. The respective axes of symmetry L1 . . . L4 of the central hair band 30 and the series of hair loops 31 are coextensive and parallel to each other. Manipulation for hair control is as previously taught.

Figure 7:
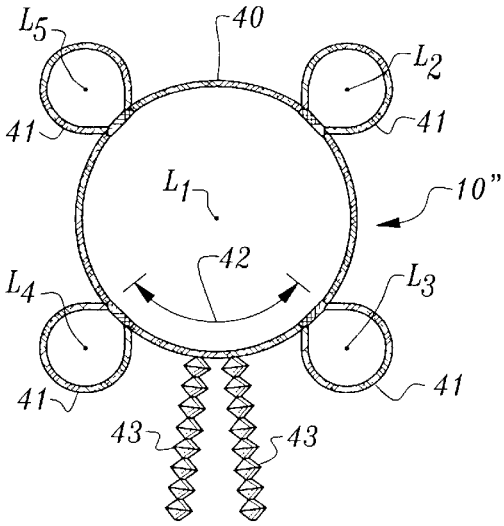
FIG. 7 is a front elevation view of yet another hair accessory of the invention showing 4 loops with beads strings attached to the central band in accordance with the invention.

FIG. 7 shows still another embodiment of the hair accessory of the invention.

As shown, hair accessary 10" is composed a central elastic band 40 having four loops 41 formed equally spaced about the central bond 40 where a segment 42 is provided neighboring loops 41 to which a series of bead strings 43 is attached. The respective axes of symmetry L1 . . . L5 of the central hair band 40 and the series of hair loops 41 are coextensive and parallel to each other. Again, hair manipulation is as previously taught.

Figure 8:
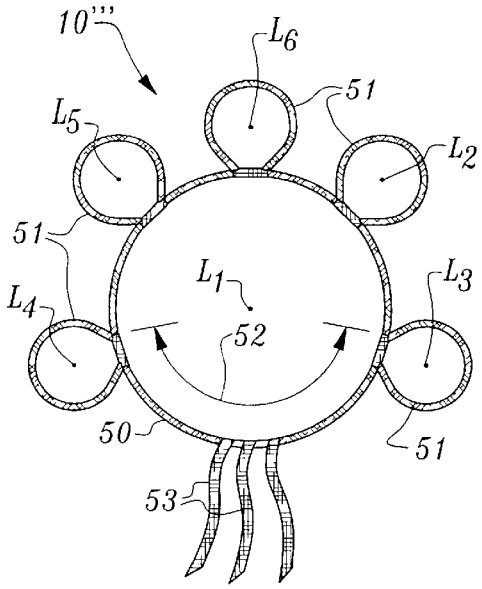
FIG. 8 is a front elevation view of still yet another hair accessory of the invention showing 5 loops with ribbon strings attached to the central band in accordance with the invention.

FIG. 8 shows still yet another embodiment of the hair accessory of the invention.

As shown, hair accessory 10'" is composed a central elastic band 50 having five loops 51 formed over about ⅔ of the total circumference of the band 50 wherein the segment 52 thereby provided is free to accommodate a series of ribbon strings 53. The respective axes of symmetry L1 . . . L6 of the central hair band 50 and the series of hair loops 51 are coextensive and parallel to each other. Again, hair manipulation is as previously taught.

Figure 9:
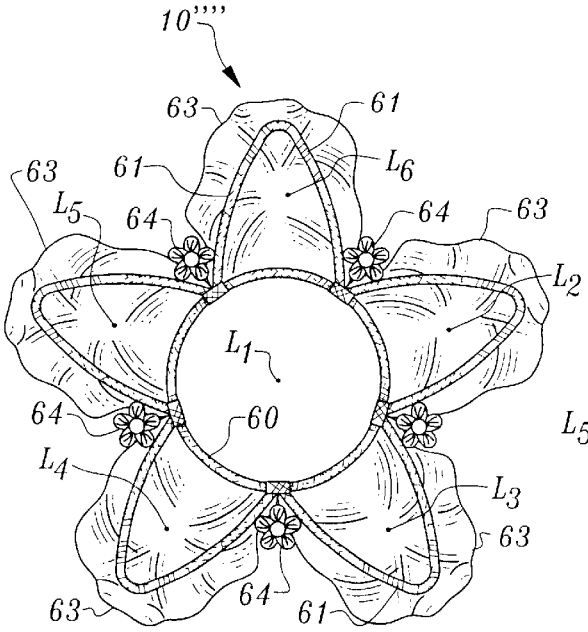
FIG. 9 is a front elevation view of still yet another hair accessory of the invention showing 5 star shaped loops with artificial flowers and lace attached to the central band in accordance with the invention.

FIG. 9 shows still yet another embodiment of the hair accessory of the invention.

As shown, hair accessory 10"" is composed a central elastic band 60 having five star shaped extensions 61 formed over the total circumference of the band 60 wherein lace domes 63 extend about the extensions 61 along with artificial flowers 64. The respective axes of symmetry L1 . . . L6 of the central hair band 60 and the series of hair loops 61 are coextensive and parallel to each other. Still again, hair manipulation is as previously taught.

Figure 10:
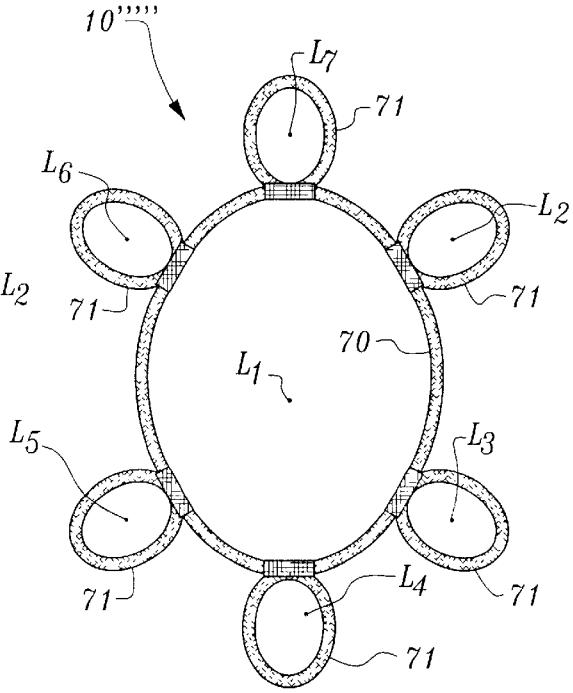
FIG. 10 is a front elevation of still yet another hair accessory composed of an oblong football shaped central elastic band (ellipsoidal) having six similarly shaped extensions formed thereover.

FIG. 10 shows still yet another embodiment of the hair accessory of the invention.

As shown, hair accessory 10"" is composed of an oblong football shaped central elastic band 70 (ellipsoidal) having six similarly shaped extensions 71 formed over the total circumference of the band 70. The respective axes of symmetry L1 . . . L7 of the central hair band 70 and the series of hair loops 71 are coextensive and parallel to each other.

While the invention has been shown and described with reference to embodiments thereof, it will be understood by those skilled in the art, that various changes, alternatives and variations in form and detail may be made without departing from the spirit and scope of the invention.

For example, the shape of the central band and loops can be changed to various arcuate segments including circular, oblong etc.

Similarly, while attachment of the loops to the central band is preferably integral, other forms such as adhesives, glues and the like could also be used.

Also different materials such as pleated scrunchy types can also be used wherein the latter are formed about an elastic ring.

What is claimed is:

1. A hair accessory for positioning on the head of a user to enhance the hair of said user, said hair accessory comprising, in combination:

an elastic central hair band having an outer circumferential surface and defining an enclosed central hair band opening for receiving a strand of the user's hair such that said strand projects outwardly from said central hair band opening when the accessory is on the user's head; and at least four elastic hair loops attached to the elastic central hair band at spaced locations on the elastic central hair band and radiating outwardly from the elastic central hair band when the accessory is on the user's head with at least one of said elastic hair loops projecting forwardly from said elastic central hair band and not in overlapping relationship therewith, at least one of said elastic hair loops projecting rearwardly from said elastic central hair band and not in overlapping relationship therewith, at least one of said elastic hair loops projecting outwardly from a first side of said elastic central hair band and not in overlapping relationship therewith, and at least one of said elastic hair loops projecting outwardly from a second side of said elastic central hair band and not in overlapping relationship therewith, each of the elastic hair loops defining an enclosed loop opening spaced from said enclosed central hair band opening and from the other enclosed loop openings, each of said enclosed loop openings being smaller when said elastic hair loops are in unstretched condition than said central hair band opening when said elastic central hair band is in unstretched condition, at least some of said elastic hair loops, when the accessory is on the user's head, receiving portions of the strand of the user's hair projecting outwardly from said central hair band opening such that each said portion passes downwardly through the enclosed loop opening of an associated elastic hair loop, at least some of said elastic hair loops and said elastic central hair band cooperable to maintain said portions in a looped condition therebetween.

2. The air accessory of claim 1 wherein said elastic central hair band and said elastic hair loops are circular when in unstretched condition.

3. The hair accessory of claim 2 in which said elastic central hair band defines a diameter D when in unstretched condition and each of said elastic hair loops defines a diameter D1 when in unstretched condition, and wherein D is greater than D1.

4. The hair accessory of claim 3 wherein D is at least about three times greater than D1.

5. The hair accessory of claim 1 in which said elastic central hair band and said elastic hair loops are oblong in shape when in unstretched condition.

6. The hair accessory of claim 1, including at least one bead string attached to said elastic central hair band.

7. The hair accessory of claim 1 including at least one ribbon string attached to said elastic central hair band.

8. A method of using a hair accessory to enhance the hair of a user, the hair accessory including an elastic central hair band having an outer circumferential surface and defining an enclosed central hair bland opening for receiving a strand of the user's hair, and at least four elastic loops attached to the elastic central hair band at spaced locations on the elastic central hair band and radiating outwardly from the elastic central hair band, each of the elastic hair loops defining an enclosed loop opening spaced from said enclosed central hair band opening and from the other enclosed loop openings, each of said enclosed loop openings being smaller when said elastic hair loops are in unstretched condition than said central hair band opening when said elastic central hair band is in unstretched condition, said method comprising the steps of:

positioning said hair accessory on the head of said user with at least one elastic hair loop projecting forwardly from said elastic central hair band and not in overlapping relationship therewith, at least one elastic hair loop projecting rearwardly from said elastic central hair band and not in overlapping relationship therewith, at least one elastic hair loop projecting outwardly from a first side of said elastic central hair band and not in overlapping relationship therewith, and at least one elastic hair loop projecting outwardly from a second side of said elastic central hair band and not in overlapping relationship therewith;

positioning said strand of the user's hair so that said strand projects outwardly from the elastic central hair band;

introducing portions of said strand into enclosed loop openings formed by at least some of said elastic hair loops to form said portions into a looped condition; and utilizing the elasticity of said elastic central hair band and the elasticity of at least some of said elastic hair loops to maintain said portions in the looped condition.

* * * * *